United States Patent [19]

Rothman

[11] 4,010,884

[45] Mar. 8, 1977

[54] METHOD OF FABRICATING A FILAMENT-REINFORCED COMPOSITE ARTICLE

[75] Inventor: Edward A. Rothman, South Glastonbury, Conn.

[73] Assignee: United Technologies Corporation, Hartford, Conn.

[22] Filed: Nov. 20, 1974

[21] Appl. No.: 525,573

[52] U.S. Cl. ..... 228/190; 228/193; 228/234; 228/263; 29/191.4; 29/195; 29/197

[51] Int. Cl.[2] ..... B23K 28/00

[58] Field of Search ..... 29/191.2, 191.4, 191.6, 29/195, 471.3, 497.5, 498, 504, 419, 420, 198, 197, 195 Y; 228/193–195, 190, 234, 263

[56] References Cited

UNITED STATES PATENTS

| | | | |
|---|---|---|---|
| 3,218,704 | 11/1965 | Kraus et al. | 29/498 X |
| 3,575,783 | 4/1971 | Kreider | 29/191.6 X |
| 3,699,623 | 10/1972 | Kreider | 29/498 X |
| 3,748,721 | 7/1973 | Alexander | 29/471.3 |

OTHER PUBLICATIONS

Garret et al. *Broad Applications of Diffusion Bonding*, NASA CR–409, Wash. D.C., 1966, pp. 177 and 162.

Niemann, J. T. and Garrett, "Eutectic Bonding of Boron–Aluminum Structural Components", 54th AWS Annual Meeting, Chicago, Ill., Apr. 2–6, 1973. Published in the Welding Journal Research Supplements: (Part I), Apr. 1974, pp. 175s–184s, and (Part II), Aug. 1974, pp. 351s–360s.

Broutman & Krock, *Composite Materials*, vol. IV, Metallic Matrix Materials, edited by Kreider, Academic Press, NY, 1974, pp. 420–421.

*Primary Examiner*—Al Lawrence Smith
*Assistant Examiner*—K. J. Ramsey
*Attorney, Agent, or Firm*—John D. Del Ponti

[57] ABSTRACT

A filament-reinforced composite article is fabricated from monolayer boron fiber tapes and laminates of titanium. The tapes which have the boron fibers attached to an aluminum foil are positioned in a multi-ply layup with interleaved titanium laminates in the form of foils or screening. The layup is subjected to heat and pressure in a diffusion bonding process to compact the layup materials and bond the fibers in the matrix of aluminum and titanium. The titanium in the matrix improves the impact load resistance of the article by improving ductility and impact strength.

6 Claims, 2 Drawing Figures

METHOD OF FABRICATING A FILAMENT-REINFORCED COMPOSITE ARTICLE

BACKGROUND OF THE INVENTION

The present invention relates to a method of fabricating filament-reinforced composite articles and, more particularly, is related to a method for improving the impact load resistance of such articles when they are struck by foreign objects which are large compared to the filament diameters.

Filament-reinforced composites have become increasingly important in the fabrication of objects such as steam or gas turbine engine blades because their anistropic strength characteristics are reasonably well suited to the loadings which such blades experience during engine operation. These properties are a high stiffness, a corresponding high strength and low density. The strength and stiffness are a direct result of the high tensile strength reinforcing filaments and thse properties vary with orientation of the filaments. For example, the greatest tensile strength and stiffness occurs in the direction parallel to the filaments and, for this reason, the blades are fabricated with the filaments extending in the radial direction which corresponds to the axis of greatest stress. In a transverse direction, however, such composites are relatively weak. Such weakness can be overcome in a composite article by orienting the filaments in adjacent layers in different directions. Forming turbine blades in this manner, however, is not desirable because of the obvious reduction in stiffness and strength in the radial direction.

There is, nevertheless, a need for greater transverse strength in turbine blades to resist fracture and possible catastrophic engine damage when large scale objects such as birds are ingested by the engine. When a blade encouners such an object, the load is first applied at its leading edge and progresses across the blade to the trailing edge. High chordwise and radial stressing results. Without some form of reinforcement, the low-ductility and impact stregnth of a composite blade can result in fracture.

The prior art methods of obtaining higher transverse impact strength include cross-plying the filament reinforced tapes, that is laying the filaments up in different directions as described above, or inserting steel or beryllium laminates in the form of foils or wire mesh between the reinforced tapes. As mentioned above, the cross-plying process results in a natural compromise of the radial strength and stiffness that the reinforcing filaments would otherwise provide in a blade. Steel mesh reinforcing is highly reactive with the aluminum foil or matrix material on which reinforcing filaments are commonly mounted to form the tapes. To avoid such reactivity, the diffusion bonding process in which the tapes in a layup are joined together can only be carried out with strict process controls. For example, the temperature to which the layups are heated is restricted and this restriction in turn requires greater pressures. Non-parallel or intersecting filaments when subjected to the greater pressures have the tendency of fracturing at their intersections. Beryllium mesh while less reactive is very expensive and, though it is strong, it is more brittle than other metals such as steel.

It has been determined that the insertion of titanium laminates between the boron filament tapes significantly improves the impact load resistance of the resulting article in directions parallel to and transverse to the filaments. At the same time, the titanium and aluminum on which the filaments are supported do not react as violently as steel and aluminum so that severely limiting controls need not be placed on the diffusion bonding process in which the tapes and laminates are joined. While titanium has been utilized in a sheath around a filament reinforced blade for erosion and corrosion protection as indicated in U.S. Pat. No. 3,699,623 having the same assignee as the present invention, it is not known to interleave titanium in a filament-reinforced matrix for improved impact load resistance.

It is accordingly a general object of the present invention to provide a method for fabricating a filament-reinforced article in which titanium is included in the filament matrix to improve impact load resistance.

SUMMARY OF THE INVENTION

The present invention resides in a method of fabricating a filament-reinforced article such as a turbine blade in order to achieve improved impact load resistance.

The method includes the step of positioning a plurality filament-reinforced foils of a low strength matrix material in a multi-ply layup. Typically, the filaments would be silicon carbide coated boron filaments which have been attached to an aluminum foil to form a reinforced tape. The tape is cut into pieces of pre-established size and shape depending upon the article to be formed, and the pieces are then laid upon one another in a predetermined arrangement.

At least one laminate of titanium is positioned in the layup between the reinforced foils. The titanium may be inserted in the layup as a foil, a perforated sheet or as a mesh screen. Then the entire layup is subjected to heat and pressure in a diffusion bonding process to join the titanium and the foils together in a matrix of aluminum and titanium containing the reinforcing filaments.

DESCRIPTION OF THE PREFERRED EMBODIMENTS

In accordance with the present invention, a filament-reinforced composite article is fabricated with improved impact load resistance by including titanium in the low-strength matrix material which holds the reinforcing filaments in a generally parallel relationship for high-strength and stiffness along an axis parallel to the filaments.

Figure 1:
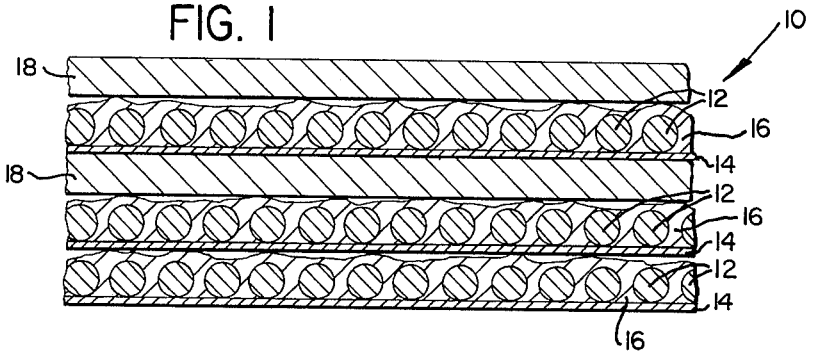
FIG. 1 illustrates a layup of filament-reinforced tapes and titanium laminates prior to being subjected to the heat and pressure of a diffusion bonding process in accordance with the present invention.

FIG. 1 illustrates a multi-ply layup, generally designated 10, of titanium laminates and the filament-reinforced tapes from which a turbine blade or other article is to be manufactured. The reinforced tapes may be of the type manufactured and sold by the Hamilton Standard Division of United Aircraft Corporation under the trademark "Borsic". Such filaments are silicon carbide coated boron filaments and are attached to a foil of aluminum or an alloy thereof such as 6061 aluminum to form the tapes in a plasma arc spraying process such as that described in U.S. Pat. 3,606,667 to Kreider. Such filament-reinforced tapes are shown in FIG. 1 comprised of the boron filaments 12, the aluminum foil 14 and the fused aluminum binder 16 which attaches the filaments to the foil. The fused aluminum covering the filaments 16 is relatively porous due to the plasma arc spraying process by which the binder is applied to the filaments and foil. Also, the surface developed by the binder and the filaments is relatively coarse and uneven.

Located on opposite sides of some of the reinforced tapes are laminates or foils 18 of titanium or a titanium alloy such as Ti6A14V. It is not essential that the titanium foils 18 be located between each of the tapes and distribution of the titanium can be varied to obtain different impact load resistances. It is also not essential that the foils 18 be distributed evenly throughout the layup. Preferably the titanium is a foil of not less than 0.004 inch (0.1 mm) which is the same order of magnitude as the diameter of the silicon carbide coated filaments referenced above. The aluminum foil 14 on which the filaments 12 are mounted is usually in the order of 0.001 inch (0.025 mm).

The individual plies of the reinforced tape are cut to a selected configuration depending upon the end article to be produced. For example, if a gas turbine blade is to be produced, the root of the blade is normally thicker than the tip and has a shape different from that of the tip. Special shapes can be obtained by stacking differently shaped plies on top of one another and by varying the number of plies used to form the different portions of the blade.

Similarly, the titanium foils may be shaped in different fashion. A greater number of titanium foils may be located adjacent the edge of the layup which forms the leading edge of the blade. Such distribution would enable the leading edge of the blade to accommodate a large portion of the impact stress when the blade is struck by a foreign object ingested at the engine inlet.

After the tapes and titanium laminates have been placed in he layup 10, the layup is positioned in an open die having a shape corresponding to the final configuration of the article to be formed. The die is closed and compresses the layup while the layup is heated by the die to a temperature slightly below the melting temperature of the aluminum. Such heating and pressing bonds the layups materials in a diffusion process and is normally conducted in a non-oxidizing atmosphere produced by enveloping the dies in an inert gas atmosphere or be generating a partial pressure around the die. The hot aluminum acting as a getter rapidly reduce any oxide on the titanium to promote the bonding.

Figure 2:
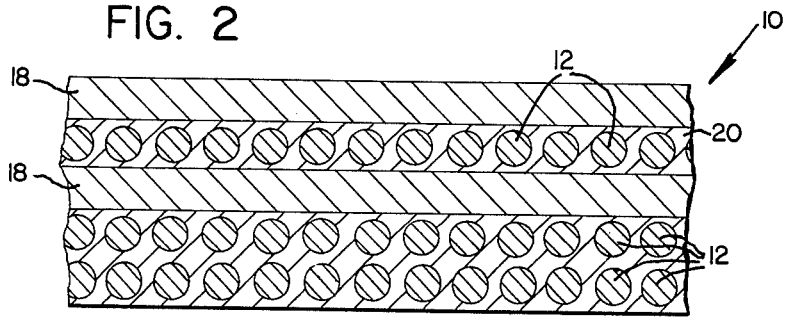
FIG. 2 illustrates in cross section the layup of FIG. 1 after the diffusion bonding process.

In a preferred form of the invention, the layup is compressed at a pressure of at last 5,000 psi and is heated to a temperature ranging between 1025° F and 1050° F for approximately 1 hour. The combined pressure and temperature compacts the layup and bonds the titanium and aluminum foils together as illustrated in FIG. 2. It will be noted that the aluminum foil 14 and aluminum binder 16 of FIG. 1 are joined in a single matrix 20 enveloping the filaments 12. The thickness of the layup is reduced primarily due to the fact that the fused aluminum binder on the raw tapes is relatively porous whereas the pressure of the diffusion bonding process forces the binder and the aluminum foil into homogenous matrix.

Testing specimens of the filament-reinforced composite including the titanium laminates has established that the impact load resistance improves as the percentage by volume of titanium in the specimen is increased. The improvement is exhibited by increases in the ductility, transverse or interlaminar strength and energy absorption of the specimens. Increased strength and energy absorption indicate, for example, that if an object is ingested into a gas turbine engine and strikes a blade, the blade is better capable of arresting the object or at least slowing the object down without fracturing. Furthermore, with greater ductility, the blade when struck by an object will bend first rather than fracture precipitously and cause disintegration of the complete engine as fragments of the blade are swallowed. The improved ductility tends ot reduce the peak loads experienced by the blade but at the same time increases the level of the impact energy absorbed. Thus the kinetic energy of the ingested object is dissipated before other structure in the engine is hit.

Charpy-type impact specimens in which the titanium foils are interleaved at 75% volume fraction of titanimum have shown as much energy absorption as 100% titanium when the specimens are struck parallel to the filaments. Ultimate transverse tensile strength of the specimen also increases with greater titanium interleaving and the increased strength is obtained in combination with improved ductility. Thusly, greater transverse impact load resistance follows.

In summary, a method of fabricating an impact-resistant composite article has been disclosed. Improved impact resistance is obtained by placing titanium laminates between filament-reinforced tapes of a low-strength matrix material in a multi-ply layup. By applying heat and pressure to the layup, the various materials join together in a diffusion bonding process and form a compact composite through which the reinforcing filaments extend. The titanium improves the impact load resistance by increasing the energy absorption properties of the article and the ductility of the article. Selective positioning of the titanium laminates within the article permits the impact load resistance properties to be varied.

While the present invention has been described in a preferred embodiment, it should be understood that variations from the disclosed peferred parameters are permitted. Reference to aluminum or titanium is intended to comprehend commercially pure qualities or alloys of the materials. The titanium laminates may take forms other than foils such as perforated sheet material, wires, and screening. Accordingly, the invention has been described in a preferred embodiment by way of illustration rather than limitation.

I claim:

1. An improved method of fabricating an impact-resistant filament-reinforced composite article having a plurality of high stiffness, high tensile strength, low density filaments in a lower strength matrix comprising:

positioning a plurality of filament-reinforced foils comprising parallel boron filaments supported on a foil and attached thereto by a fused binder in a multi-ply layup, said foil and said binder consisting essentially of aluminum or alloys thereof;

placing at last one laminate of titanium or an alloy thereof between the filament-reinforced foils; and subjecting the multi-ply layup to heat and pressure in a diffusion bonding process to join the titanium and the reinforced foils together in a matrix containing the reinforcing filaments.

2. An improved method of fabricating as defined in claim 1 wherein the boron filaments are silicon carbide coated boron filaments.

3. A method of fabricating a filament reinforced composite article as defined in claim 1 wherein:

the titanium laminate placed between the filament reinforced foils is a titanium foil not less than 0.004 inch (0.1 mm) in thickness.

4. A method of fabricating a filament-reinforced composite article as in claim 1 wherein the step of subjecting the multi-ply layup to hat and pressure includes heating the layup to a temperature not greater than 1050° F.

5. The method of fabricating as in claim 4 wherein the step of subjecting includes pressing the plies together at a pressure not less than 5000 psi.

6. The method of fabricating a filament reinforced composite article as defined in claim 1 wherein the step of positioning comprises positioning all of the filament-reinforced foils with the filaments extending in the same direction.

* * * * *